US011126113B2

(12) United States Patent
Lee et al.

(10) Patent No.: US 11,126,113 B2
(45) Date of Patent: Sep. 21, 2021

(54) STRUCTURE FOR RELEASING INTERNAL PRESSURE IN DEVELOPMENT CARTRIDGE WHEN REFILLING TONER

(71) Applicant: HEWLETT-PACKARD DEVELOPMENT COMPANY, L.P., Spring, TX (US)

(72) Inventors: Seung Gweon Lee, Pangyo (KR); Ji Won Moon, Suwon (KR); Woong Yong Choi, Suwon (KR); Yong Il Moon, Suwon (KR); Yong Nam Ahn, Suwon (KR); Jin Hwa Hong, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/047,490

(22) PCT Filed: Dec. 4, 2018

(86) PCT No.: PCT/KR2018/015226
§ 371 (c)(1),
(2) Date: Oct. 14, 2020

(87) PCT Pub. No.: WO2020/022585
PCT Pub. Date: Jan. 30, 2020

(65) Prior Publication Data

US 2021/0149327 A1 May 20, 2021

(30) Foreign Application Priority Data

Jul. 26, 2018 (KR) ..... 10-2018-0087217

(51) Int. Cl.
*G03G 15/08* (2006.01)

(52) U.S. Cl.
CPC ..... *G03G 15/0894* (2013.01); *G03G 15/0877* (2013.01); *G03G 15/0898* (2013.01); *G03G 15/0874* (2013.01)

(58) Field of Classification Search
CPC ..... G03G 15/0894; G03G 15/0877; G03G 15/0898; G03G 15/0874
See application file for complete search history.

(56) References Cited

U.S. PATENT DOCUMENTS 8,774,685 B1 7/2014 Leemhuis et al.
9,360,799 B2 6/2016 Itabashi
(Continued)

FOREIGN PATENT DOCUMENTS

EP 2624069 8/2013
EP 3026498 6/2016
(Continued)

*Primary Examiner* — Arlene Heredia
(74) *Attorney, Agent, or Firm* — Trop Pruner & Hu, P.C.

(57) ABSTRACT

A development cartridge is provided. The development cartridge includes a toner container, having a first air vent and a second air vent, to accommodate a toner, a developing portion to receive the toner from the toner container and having a developing roller installed therein, a toner refilling portion, connected to an end of the toner container in a longitudinal direction, to provide the toner container with a passage for refilling the toner, a filter installed in the first air vent to reduce leakage of the toner, and a pressure releasing member to communicate with the toner container via the second air vent and being transformable in a contracted state and an expanded state to expand a volume of the toner container, wherein the first air vent is formed at a position farther from the toner refilling portion than the second air vent.

15 Claims, 7 Drawing Sheets

(56) References Cited

U.S. PATENT DOCUMENTS

| | | | | |
|---|---|---|---|---|
| 2004/0027430 | A1 | 2/2004 | Anderson et al. | |
| 2006/0290753 | A1 | 12/2006 | Tatsumi et al. | |
| 2014/0363210 | A1* | 12/2014 | Nishida ..... | G03G 15/0874 399/258 |

FOREIGN PATENT DOCUMENTS

| | | |
|---|---|---|
| JP | 2005170027 | 6/2005 |
| JP | 2006023755 | 1/2006 |
| JP | 2008268283 | 11/2008 |
| JP | 2009053274 | 3/2009 |
| JP | 2014010341 | 1/2014 |
| JP | 2015102599 | 6/2015 |

* cited by examiner

[Fig. 1]
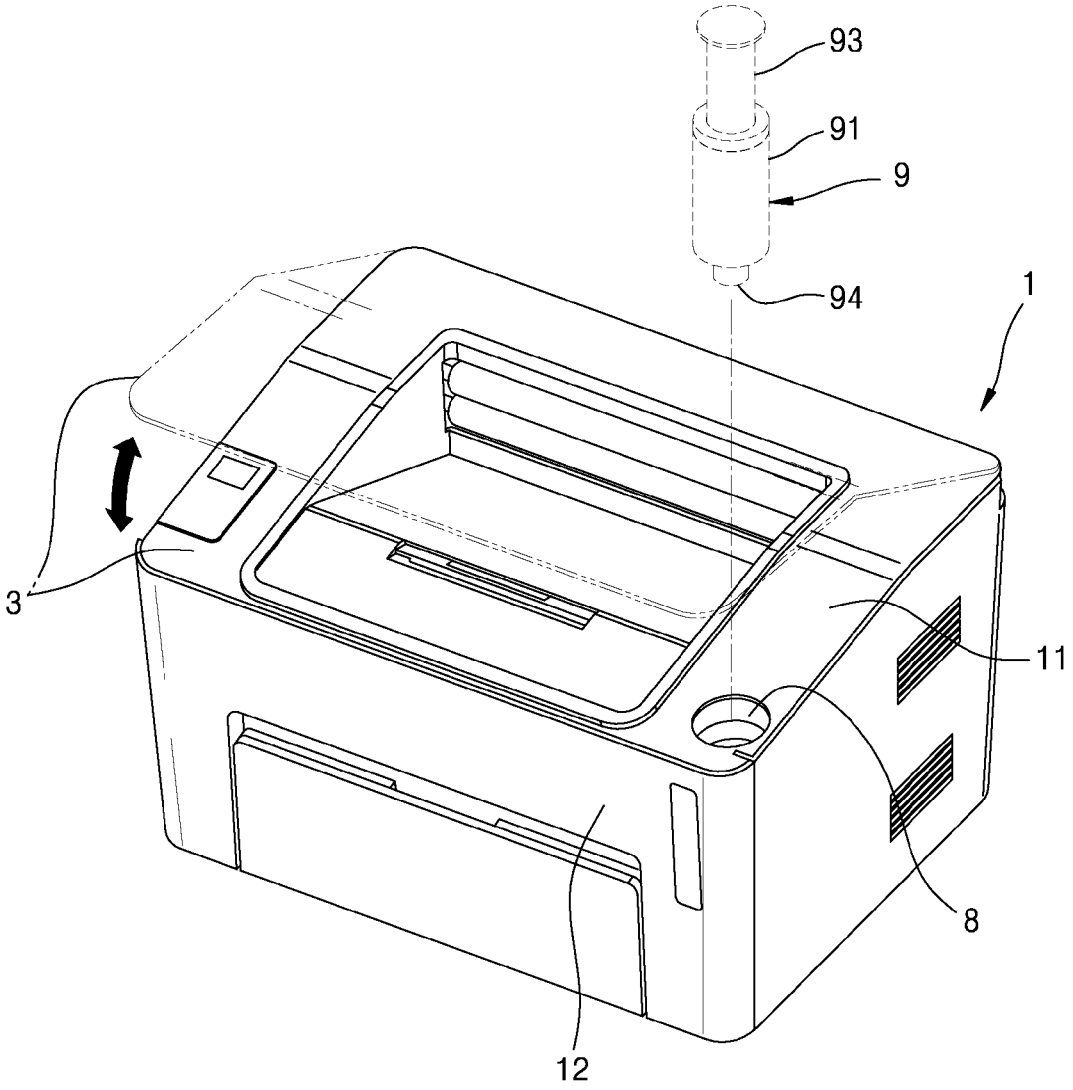

[Fig. 2]
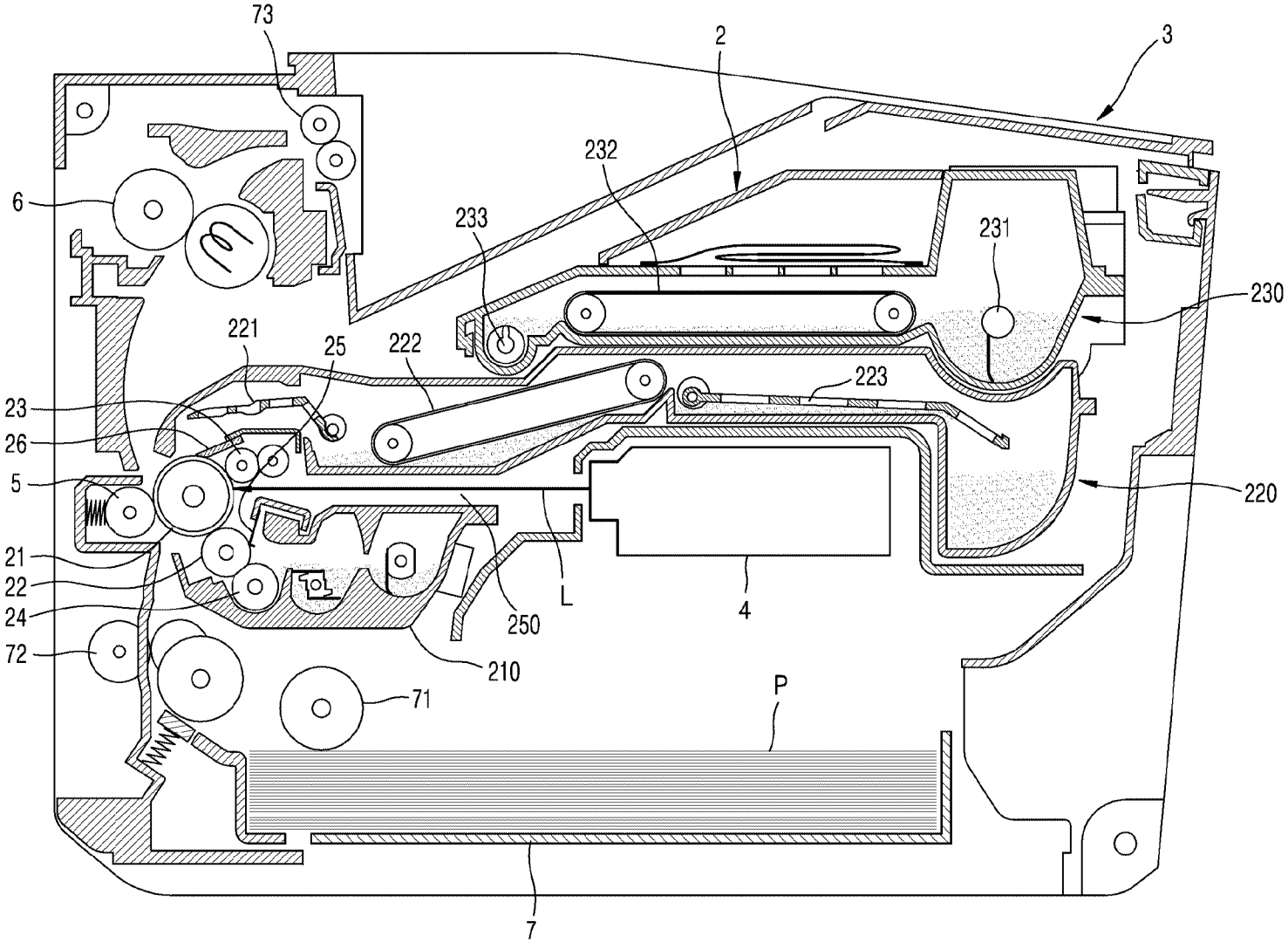

[Fig. 3]
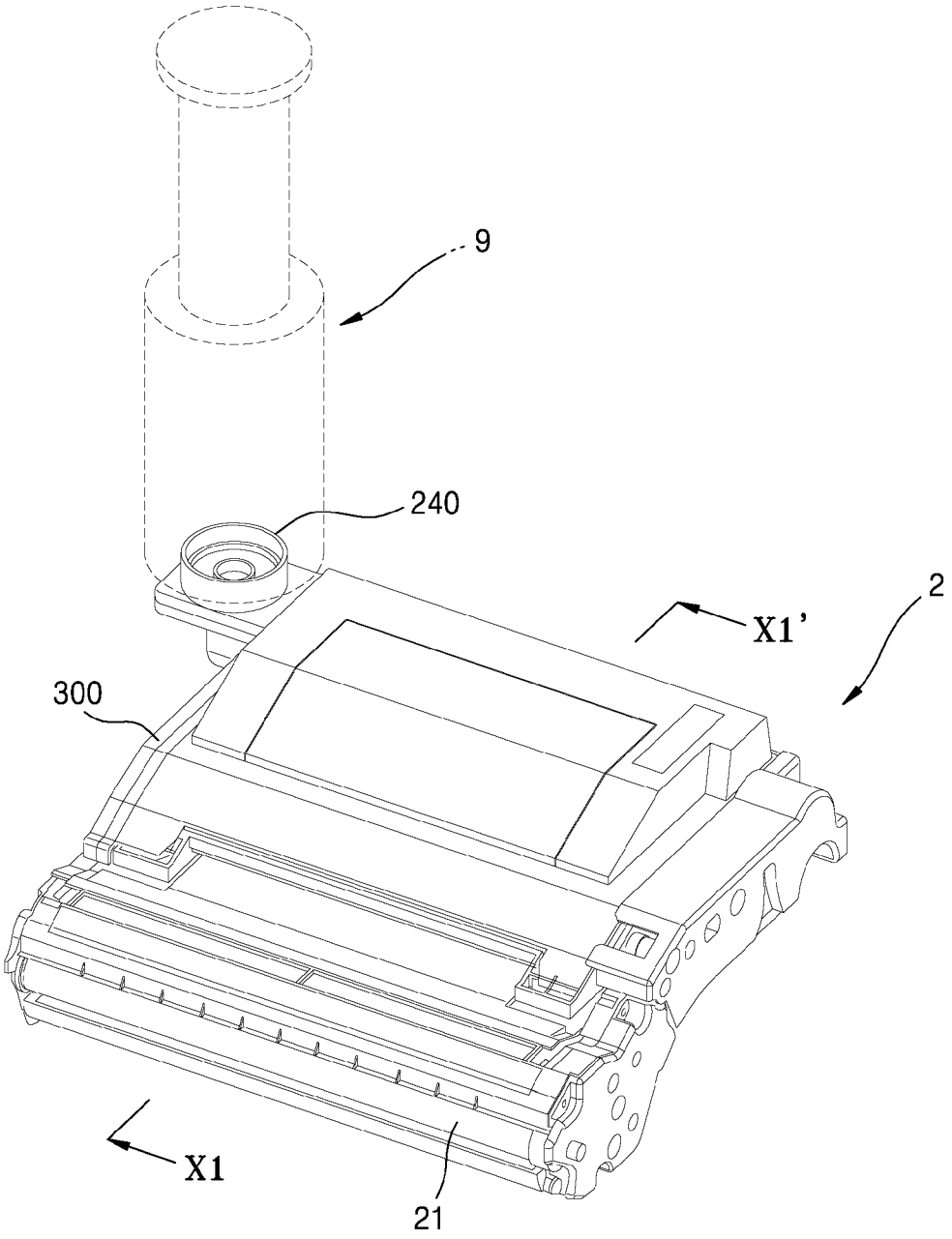

[Fig. 4]
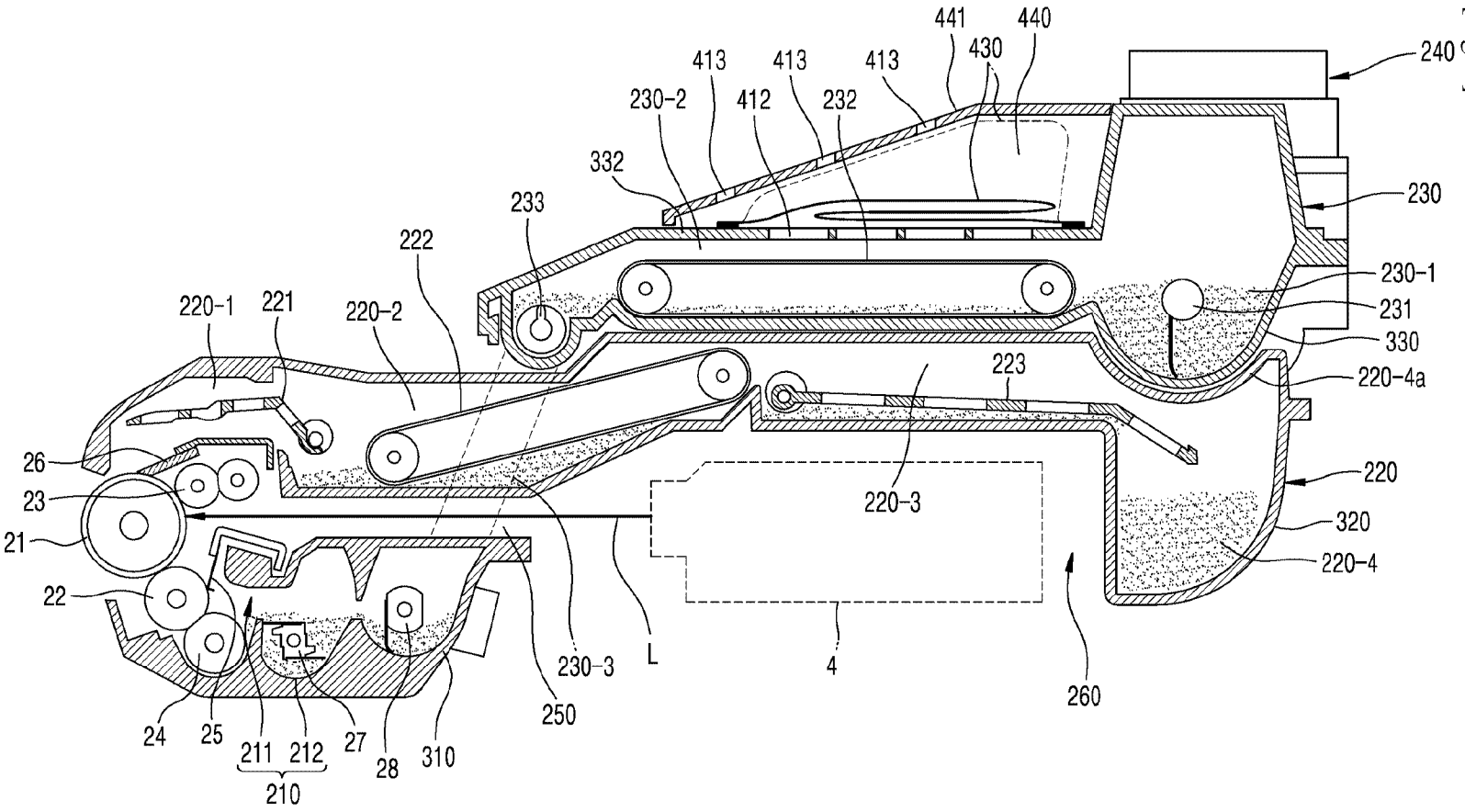

[Fig. 5]
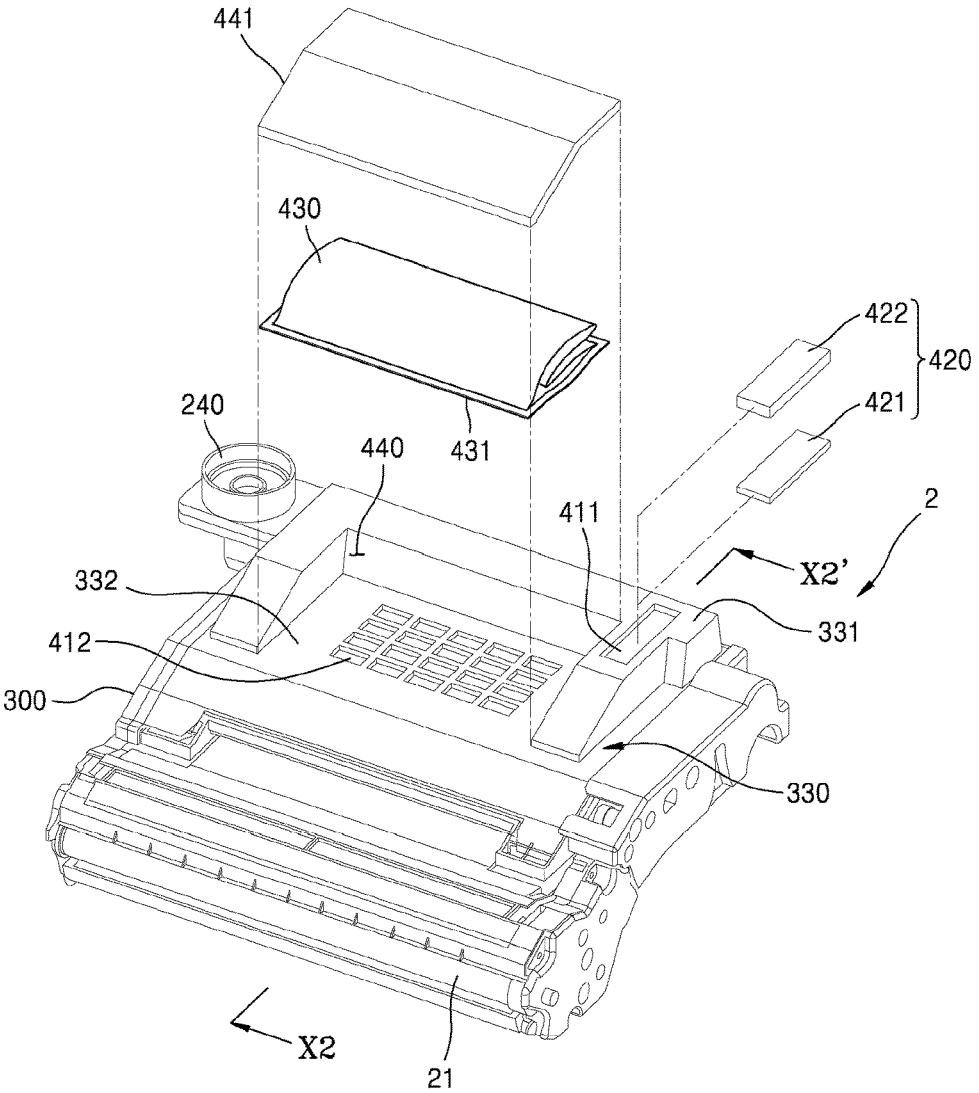
[Fig. 6]
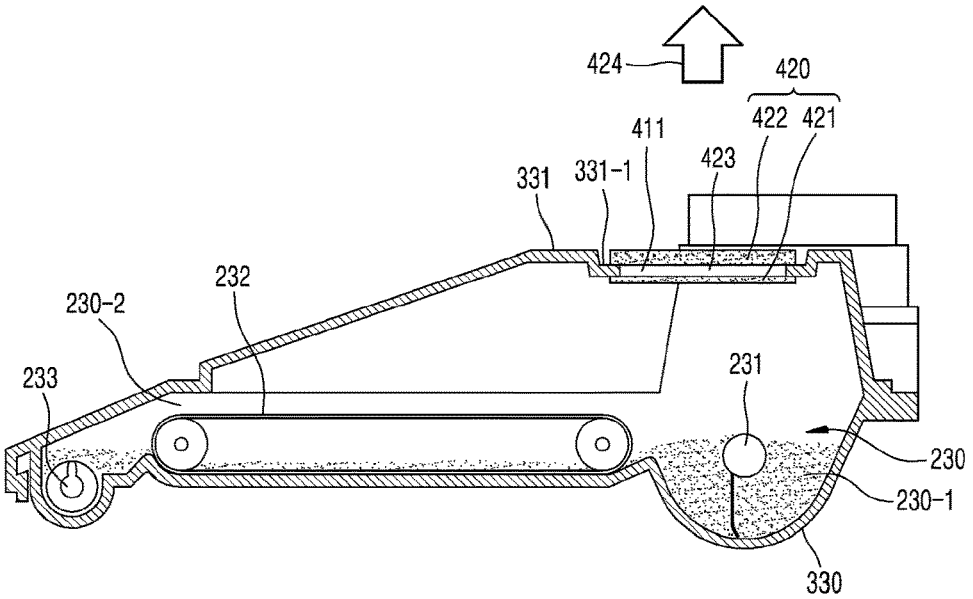

[Fig. 7]
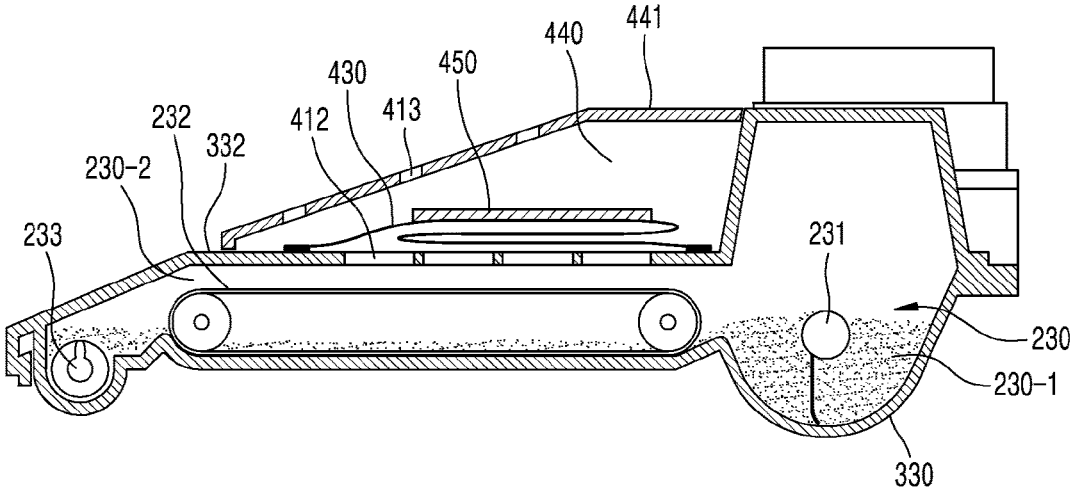
[Fig. 8]
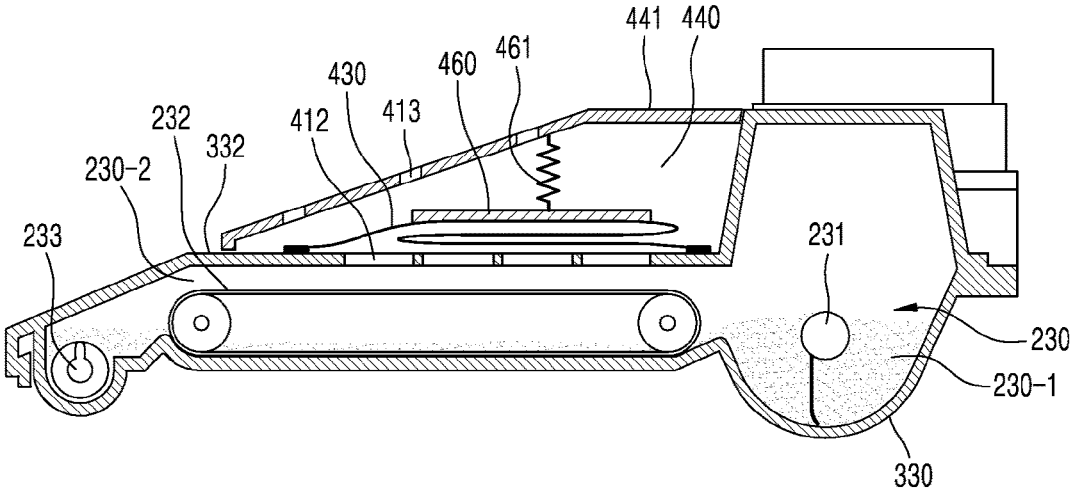
[Fig. 9]
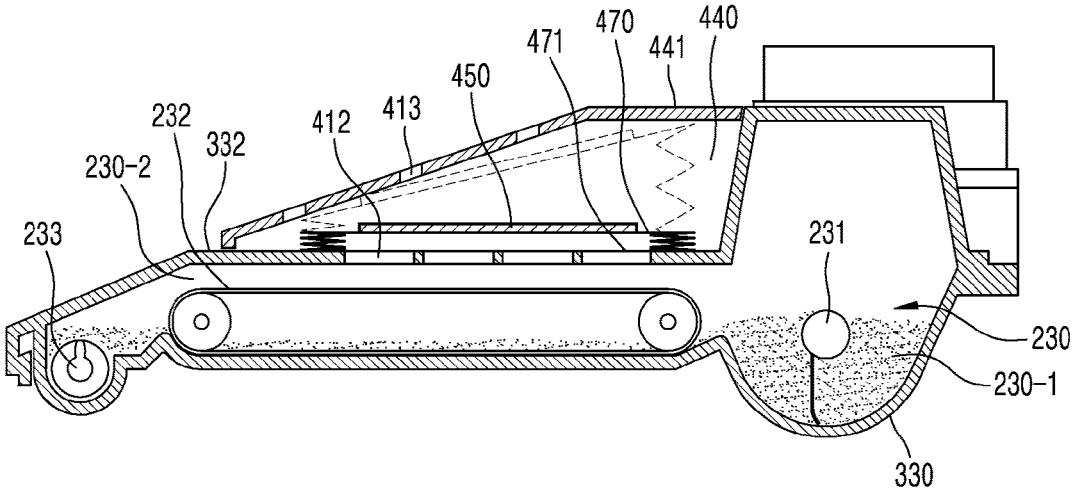

[Fig. 10]
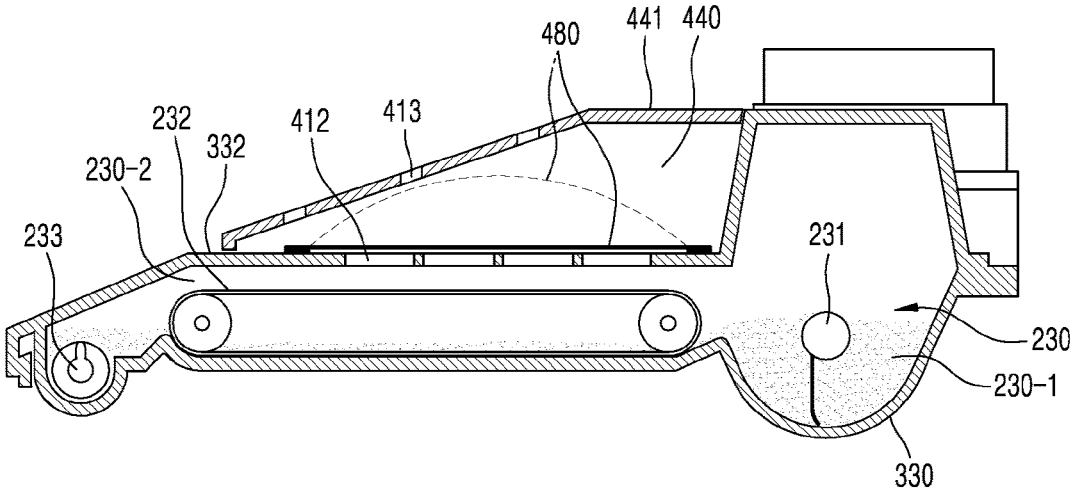

STRUCTURE FOR RELEASING INTERNAL PRESSURE IN DEVELOPMENT CARTRIDGE WHEN REFILLING TONER

BACKGROUND ART

A printer using an electrophotographic method supplies toner to an electrostatic latent image formed on a photoconductor so as to form a visible toner image on the photoconductor. The visible toner image on the photoconductor is transferred through an intermediate transfer medium or directly to a print medium and the transferred toner image is fixed onto the print medium.

A development cartridge accommodates toner and supplies the toner to an electrostatic latent image formed on a photoconductor so as to form a visible toner image. When the toner accommodated in the development cartridge is consumed, the development cartridge may be removed from a main body of a printer and a new development cartridge may be mounted in the main body. Also, new toner may be refilled in the development cartridge by using a toner refill kit (e.g., a toner refill cartridge).

BRIEF DESCRIPTION OF DRAWINGS

The above and other aspects, features, and advantages of certain examples of the present disclosure will be more apparent from the following description taken in conjunction with the accompanying drawings, in which:

FIG. 1 is a schematic external perspective view of a printer, according to an example;

FIG. 2 is a schematic configuration diagram of a printer, such as the printer shown in FIG. 1, according to an example;

FIG. 3 is a perspective view of a development cartridge employed in a printer, such as the printer shown in FIG. 1, according to an example;

FIG. 4 is a cross-sectional view of the development cartridge taken along a line X1-X1' of FIG. 3, according to an example;

FIG. 5 is a partially-exploded perspective view of a development cartridge to which an internal pressure releasing structure is applied, according to an example;

FIG. 6 is a cross-sectional view of the development cartridge taken along a line X2-X2' of FIG. 5, according to an example;

FIG. 7 is a partial cross-sectional view of a development cartridge to which an internal pressure releasing structure is applied, according to an example;

FIG. 8 is a partial cross-sectional view of a development cartridge to which an internal pressure releasing structure is applied, according to an example;

FIG. 9 is a partial cross-sectional view of a development cartridge to which an internal pressure releasing structure is applied, according to an example; and FIG. 10 is a partial cross-sectional view of a development cartridge to which an internal pressure releasing structure is applied, according to an example.

Throughout the drawings, it should be noted that like reference numbers are used to depict the same or similar elements, features, parts, components, and structures.

MODE FOR THE INVENTION

Various examples now will be described more fully hereinafter with reference to the accompanying drawings. The examples described hereinafter may be modified in many different forms. To more clearly describe features of examples, matters well known to one of ordinary skill in the art to which the below examples pertain will not be described in detail.

Throughout the description, when an element is referred to as being "connected" or "coupled" to another element, it can be directly connected or coupled to the other element, or can be connected or coupled to the other element with intervening elements interposed therebetween. In addition, the terms "comprises" and/or "comprising" or "includes" and/or "including" when used in this description, specify the presence of stated elements, but do not preclude the presence or addition of one or more other elements.

FIG. 1 is a schematic external perspective view of a printer, according to an example.

FIG. 2 is a schematic configuration diagram of a printer, such as the printer shown in FIG. 1, according to an example.

Referring to FIGS. 1 and 2, the printer may include a main body 1, and a developing device 2 in a cartridge form mountable/demountable in/from the main body 1. Hereinafter, the developing device 2 may be referred to as the development cartridge 2. The main body 1 may be provided with a door 3. The door 3 may open and close a portion of the main body 1. Although FIG. 1 shows the door 3 that opens an upper portion of the main body 1, a door that opens a side portion or a front portion of the main body 1 may be employed when required. The door 3 may be opened and the development cartridge 2 may be mounted/demounted in/from the main body 1.

The development cartridge 2 may include a photosensitive drum 21 and a developing roller 22. The photosensitive drum 21 is an example of a photoconductor on which an electrostatic latent image may be formed. The photosensitive drum 21 may include a cylindrical metal pipe and a photoconductive layer, formed on an outer circumference portion of the cylindrical metal pipe, having a photoconductivity. A charging roller 23 is an example of a charger configured to charge a surface of the photosensitive drum 21 to have a uniform potential. A charging bias voltage may be applied to the charging roller 23. A corona charger (not shown) may be used instead of the charging roller 23. The developing roller 22 supplies a toner to an electrostatic latent image formed on the surface of the photosensitive drum 21, and develops the electrostatic latent image into a toner image.

In a case of a two-component developing method using a toner and a carrier as developing agents, the developing roller 22 may be in a form in which a magnet is fixedly installed inside a rotatable sleeve. The sleeve may be positioned apart from the photosensitive drum 21 by several tens to several hundreds of micrometers. The carrier may be attached to an outer circumference portion of the developing roller 22 due to a magnetic force of the magnet, and the toner may be attached to the carrier due to an electrostatic force, such that a magnetic brush including the carrier and the toner is formed on the outer circumference portion of the developing roller 22. Only the toner is transported to the electrostatic latent image formed on the photosensitive drum 21 due to a developing bias voltage applied to the developing roller 22.

In a case of a one-component developing method using a toner as a developing agent, the developing roller 22 may contact the photosensitive drum 21 or may be positioned apart from the photosensitive drum 21 by several tens to several hundreds of micrometers. In the present example, a one-component contact-developing method, in which the developing roller 22 and the photosensitive drum 21 are in contact with each other to form a development nip, is employed. The developing roller 22 may include a conductive metal core (not shown) and an elastic layer (not shown) formed on an outer circumference portion of the conductive metal core (not shown). When the developing bias voltage is applied to the developing roller 22, the toner is transported and attached to the electrostatic latent image formed on the surface of the photosensitive drum 21 via the development nip.

The development cartridge 2 may further be provided with a supplying roller 24 to attach the toner to the developing roller 22. A supply bias voltage may be applied to the supplying roller 24 to attach the toner to the developing roller 22. A regulating member 25 may regulate an amount of toner attached to the surface of the developing roller 22. The regulating member 25 may be, for example, a regulating blade whose tip contacts the developing roller 22 by a predetermined pressure. A cleaning member 26 may remove a residual toner and foreign substances from the surface of the photosensitive drum 21, before the photosensitive drum 21 is charged. The cleaning member 26 may be, for example, a cleaning blade whose tip contacts the surface of the photosensitive drum 21. The foreign substances removed from the surface of the photosensitive drum 21 are referred to as a waste toner.

An optical scanner 4 irradiates light onto the surface of the photosensitive drum 21 charged to have the uniform potential, the light being modulated according to image information. For example, as the optical scanner 4, a laser scanning unit (LSU) that deflects, by using a polygon mirror, light irradiated from a laser diode in a main scanning direction and irradiates the light onto the photosensitive drum 21 may be used.

A transfer roller 5 is an example of a transfer unit that is positioned opposite to the photosensitive drum 21 so as to form a transfer nip. A transfer bias voltage is applied to the transfer roller 5 so as to transfer a toner image developed on the surface of the photosensitive drum 21 to a print medium P. In an example, a corona transfer unit may be used instead of the transfer roller 5.

The toner image transferred to a surface of the print medium P by the transfer roller 5 is maintained on the surface of the print medium P due to electrostatic attraction. A fuser 6 forms a permanent printed image on the print medium P by fixing the toner image on the print medium P by applying heat and pressure to the toner image.

An example of an image forming process according to the above-described example configuration will now be briefly described. The charging bias voltage is applied to the charging roller 23 and the photosensitive drum 21 is charged to have the uniform potential. The optical scanner 4 irradiates the light modulated according to image information to the photosensitive drum 21 and forms the electrostatic latent image on the surface of the photosensitive drum 21. The supplying roller 24 attaches the toner to the surface of the developing roller 22. The regulating member 25 forms a toner layer with a uniform thickness on the surface of the developing roller 22. The developing bias voltage is applied to the developing roller 22. The toner that is conveyed to the development nip due to rotation of the developing roller 22 is transported and attached to the electrostatic latent image formed on the surface of the photosensitive drum 21 due to the developing bias voltage such that a visible toner image is formed on the surface of the photosensitive drum 21. The print medium P, withdrawn from a loading tray 7 by a pickup roller 71, is transported by a transporting roller 72 to the transfer nip where the transfer roller 5 and the photosensitive drum 21 face each other. When the transfer bias voltage is applied to the transfer roller 5, the toner image is transferred to the print medium P due to electrostatic attraction. The toner image that has been transferred to the print medium P receives heat and pressure from the fuser 6 and is fixed on the print medium P, such that printing is completed. The print medium P is discharged by a discharge roller 73. A residual toner on the surface of the photosensitive drum 21, without being transferred to the print medium P, is removed by the cleaning member 26.

FIG. 3 is a perspective view of a development cartridge employed in a printer, such as the printer shown in FIG. 1, according to an example.

FIG. 4 is a cross-sectional view of the development cartridge taken along a line X1-X1' in FIG. 3, according to an example.

Referring to FIG. 3 and FIG. 4, an example of a development cartridge 2 is described.

The development cartridge 2 may include a development portion 210 to which the photosensitive drum 21 and the developing roller 22 are installed, a waste toner container 220 accommodating a waste toner removed from the photosensitive drum 21, and a toner container 230 connected to the development portion 210 and accommodating a toner. To refill the toner in the toner container 230, the development cartridge 2 includes a toner refilling portion 240 connected to the toner container 230. The toner refilling portion 240 provides an interface between a toner cartridge (e.g., a toner refilling cartridge) 9 and the development cartridge 2. The development cartridge 2 may be an integrated-type development cartridge including the developing portion 210, the waste toner container 220, the toner container 230, and the toner refilling portion 240.

The developing portion 210, the waste toner container 220, and the toner container 230 may be stacked in a vertical direction. A light path 250, in which exposure light L passes through to expose the photosensitive drum 21, is formed between the developing portion 210 and the waste toner container 220. The development cartridge 2 may be provided with a recessed portion 260 generating a space for accommodating the optical scanner 4. As shown in FIG. 2, when the development cartridge 2 is mounted in the main body 1, the optical scanner 4 is positioned in the recessed portion 260.

A housing 300 forming an exterior of the development cartridge 2 may include a lower frame 310, an intermediate frame 320, and an upper frame 330. The developing portion 210, the waste toner container 220, and the toner container 230 may be formed by the lower frame 310, the intermediate frame 320, and the upper frame 330. The lower frame 310 and the intermediate frame 320 are spaced apart in the vertical direction, therefore, the light path 250, in which the exposure light L passes through, is formed between the lower frame 310 and the intermediate frame 320.

The developing portion 210 is installed with the photosensitive drum 21 and the developing roller 22. A portion of the outer circumference portion of the photosensitive drum 21 is exposed to an exterior of the housing 300. The transfer roller 5 contacts the exposed portion of the photosensitive drum 21 so as to form a transfer nip. The developing portion 210 may include a developing room (e.g., area) 211 and a main hopper 212 positioned between the developing room 211 and the toner container 230, based on a supply path of the toner. In an example, the developing room 211 may be installed with the developing roller 22 and the photosensitive drum 21. The main hopper 212 may be installed with conveying members 27 and 28 conveying the toner to the developing room 211. The conveying members 27 and 28 may also stir the toner and charge the toner to have a predetermined potential. FIG. 4 shows two conveying members 27 and 28. However, in consideration of a capacity and a shape of the main hopper 212, an appropriate number of conveying members for effectively supplying the toner to the developing room 211 may be installed in the main hopper 212 at appropriate positions. As an example, the conveying members 27 and 28 may be paddles provided with one or a plurality of agitating blades in the form of a flexible film with respect to a rotation axis.

The waste toner container 220 is positioned on an upper side of the developing portion 210. As described above, the waste toner container 220 is spaced upward from the developing portion 210 and the light path 250 is formed between the waste toner container 220 and the developing portion 210. The waste toner that is removed from the photosensitive drum 21 by the cleaning member 26 is accommodated in the waste toner container 220. The waste toner container 220 extends back farther than a length of the developing portion 210 from an end near the photosensitive drum 21, the end having the cleaning member 26 installed thereon. The recessed portion 260, in which the optical scanner 4 to the rear of the developing portion 210 is accommodated, may be defined by the developing portion 210 having a length shorter than that of the waste toner container 220, and the waste toner container 220 positioned at an upper side of the developing portion 210.

For example, the waste toner container 220 may include a first portion 220-1, a second portion 220-2, and a third portion 220-3, which are sequentially positioned from a vicinity of the photosensitive drum 21. The first portion 220-1 may be positioned in the vicinity of the photosensitive drum 21 and primarily accommodates the waste toner. The third portion 220-3 corresponds to the recessed portion 260 and may be positioned stepping upward compared with the first portion 220-1. The second portion 220-2 connects the first portion 220-1 and the third portion 220-3. Therefore, the second portion 220-2 has a form upwardly inclining from the first portion 220-1 towards the third portion 220-3. The waste toner container 220 may further include a fourth portion 220-4, to the rear of the recessed portion 260, extending downward from the third portion 220-3. By doing so, a larger space for accommodating the waste toner may be obtained. The waste toner container 220 may be installed with one or more waste toner transporting members for transporting the waste toner from the photosensitive drum 21 to a location away from the photosensitive drum 21. According to an example, the waste toner container 220 may include a first waste toner transporting member 221, a second waste toner transporting member 222, and a third waste toner transporting member 223, which are sequentially arranged from a vicinity of the photosensitive drum 21. The first waste toner transporting member 221, the second waste toner transporting member 222, and the third waste toner transporting member 223 may have various structures capable of transporting the waste toner from the photosensitive drum 21 into the waste toner container 220.

As illustrated in FIGS. 3 and 4, the toner container 230 includes a hopper portion 230-1 connected to the toner refilling portion 240 and accommodating the toner. The hopper portion 230-1 may be positioned at a position apart from a toner supplying portion 230-3 in a rear direction. For example, the hopper portion 230-1 may be positioned above the fourth portion 220-4 of the waste toner container 220. An upper wall 220-4*a* of the fourth portion 220-4 may be partially downwardly imbedded in the fourth portion 220-4, and the hopper portion 230-1 may be formed in a shape complementary to the upper wall 220-4*a* and downwardly convex. By doing so, a larger capacity of the hopper portion 230-1 may be obtained.

The toner container 230 includes a connective path portion 230-2 extending forward from the hopper portion 230-1, that is, towards the developing portion 210. The connective path portion 230-2 extends to an upper side of the developing portion 210 and is connected to the developing portion 210 by the toner supplying portion 230-3 as shown by a dotted line in FIG. 4. According to an example of the development cartridge 2, the waste toner container 220 may be provided between the developing portion 210 and the toner container 230. In addition, the light path 250 may be arranged between the developing portion 210 and the waste toner portion 220. The toner supplying portion 230-3 may be connected to the developing portion 210, for example, the main hopper 212, by penetrating the waste toner portion 220 in a vertical direction. The toner supplying portion 230-3 may be positioned so as not to interfere with the exposure light L that is irradiated by the optical scanner 4 in the main scanning direction. That is, the toner supplying portion 230-3 may be positioned outside an effective width of the exposure light L. The toner supplying portion 230-3 may be positioned inside a length of the photosensitive drum 21. With such a structure, since the toner supplying portion 230-3 may be positioned inside the length of the photosensitive drum 21, a compact development cartridge 2 may be implemented.

The toner container 230 may be installed with one or more toner supplying members to supply the toner to the developing portion 210 via the toner supplying portion 230-3. A type and a number of the toner supplying member are not limited. In consideration of a volume and a type of toner container 230, the toner container 230 may be installed with an appropriate number of the toner supplying member at an appropriate position so as to effectively supply the toner to the developing portion 210. As an example, a first toner supplying member 231 may be installed in the hopper portion 230-1 and conveys a toner inside the hopper portion 230-1 to the connective path portion 230-2. For example, the first toner supplying member 231 may be in a shape of a paddle provided with one or a plurality of agitating blades which is/are in the form of a flexible film with respect to the rotation axis. A second toner supplying member 232 may be installed in the connective path portion 230-2, may receive a toner from the first toner supplying member 231, and may convey the toner received from the first toner supplying member 231 to the toner supplying portion 230-3. As an example, the second toner supplying member 232 may be in a form of a belt extending and circulating along the connective path portion 230-2. A plurality of penetrating holes may be formed in the belt to secure a toner supplying ability. Although not illustrated in drawings, a plurality of outwardly protruding conveying pins may be provided on a surface of an outer circumference portion of the belt. A third toner supplying member 233 may be positioned near an end of the connective path portion 230-2 in a side of the developing portion 210. The third supplying member 233 may be positioned above the toner supplying portion 230-3. Since the toner supplying portion 230-3 may be positioned outside the effective width of the exposure light L in the main scanning direction, the third toner supplying member 233 may receive toner from the second toner supplying member 232, may convey the toner received from the second toner supplying member 232 in the main scanning direction, and may convey the same to the toner supplying portion 230-3. For example, the third toner supplying member 233 may be implemented by an auger having a rotational axis extending in the main scanning direction and a spiral wing formed on an outer circumference portion of the rotation axis. When two toner supplying portions 230-3 that are apart in the main scanning direction are provided, the spiral wing may be divided into two spiral wings having different spiral directions based on a central portion of the main scanning direction, such that the third toner supplying member 233 may convey the toner to both sides in the main scanning direction.

Based on the aforementioned example configuration, a toner accommodated in the hopper portion 230-1 may be supplied to the developing portion 210, for example, the main hopper 212, via the connective path portion 230-2 and the toner supplying portion 230-3. According to an example development cartridge 2 including the main hopper 212 in addition to the toner container 230, an initial toner capacity may be increased, therefore, a lifetime of the development cartridge 2 may be elongated and the development cartridge 2 of a larger capacity may be realized.

As described in the examples above, the development cartridge 2 may include the toner refilling portion 240 capable of refilling the toner. According to an example, the development cartridge 2 may not be detached from the main body 1 to refill the toner into the development cartridge 2. The toner may be refilled into the development cartridge 2, when the development cartridge 2 is in a state of being installed in the main body 1.

Referring again to FIG. 1, the main body 1 may be provided with a communicating portion 8 such that the toner refilling portion 240 may be accessible from an outside of the main body 1 while the development cartridge 2 is mounted in the main body 1. For example, when the toner cartridge 9 accommodating the toner is inserted into the communicating portion 8, the toner cartridge 9 may be connected to the toner refilling portion 240. In this state, the toner accommodated in the toner cartridge 9 may be refilled into the toner container 230 via the toner refilling portion 240. The toner cartridge 9 may be removed from the communicating portion 8 after the toner is refilled.

Based on the aforementioned configuration, since the toner container 230 may be refilled with the toner via the toner refilling portion 240, a replacement period of the development cartridge 2 may be extended, such as until a lifetime of the photosensitive drum 21 is ended, a printing cost per sheet is reduced, or the like. Also, since the development cartridge 2 may be refilled with the toner while the development cartridge 2 is mounted in the main body 1, a user's convenience may be improved.

The communicating portion 8 may be provided at a position near a front portion 12 of the main body 1. Since the front portion 12 faces a user, the user may easily access the communicating portion 8. Therefore, a toner refilling operation via the communicating portion 8 may be more easily performed.

The communicating portion 8 may be provided in a top portion 11 of the main body 1. The toner refilling portion 240 may be positioned under the communicating portion 8. The communicating portion 8 and the toner refilling portion 240 may be aligned in the vertical direction. The toner cartridge 9 may access the toner refilling portion 240 from an upper side of the main body 1 via the communicating portion 8.

As illustrated in FIG. 1, the toner cartridge 9 may be a syringe-type toner refilling cartridge including a hollow body 91 having an internal space in which the toner is accommodated, and a plunger 93 movably coupled to the hollow body 91 in a longitudinal direction to push the toner out of the hollow body 91. The hollow body 91 may have, for example, a cylindrical shape. An end of the hollow body 91 may be provided with a discharge hole 94 to discharge the toner and a discharge shutter (not shown) to open and close the toner discharge hole 94. The discharge shutter may open the toner discharge hole 94 when the toner cartridge 9 is mounted in the toner refilling portion 240.

The toner cartridge 9 may be inserted into the communicating portion 8 from an upper side with respect to the main body 1 in a vertical direction (i.e., a gravity direction). Since the communicating portion 8 and the toner refilling portion 240 are aligned in the vertical direction, the toner cartridge 9 may be easily connected to the toner refilling portion 240 via the communicating portion 8. The toner refilling portion 240 may be connected to the toner container 230, for example, the hopper unit 230-1. In this state, when the plunger 93 is pressed, the toner accommodated in the internal space of the hollow body 91 may be refilled into the toner container 230, via the toner refilling portion 240. When the refilling is completed, the toner cartridge 9 may be removed from the main body 1.

An internal pressure of the toner container 230 may be increased in a process of refilling the toner. For example, when the plunger 93 is pressed, the internal pressure of the toner container 230 may increase. As an example, when the plunger 93 is quickly pressed, the internal pressure of the toner container 230 may be sharply increased. Since the toner container 230 is connected to the developing portion 210, an internal pressure of the developing portion 210 may also be increased. In that case, toner may leak outside of the housing 300 via a gap between the housing 300 and the photosensitive drum 21, a gap between the housing 300 and the developing roller 22, or another gap. The leaked toner may contaminate an inside of the main body 1. In addition, an increase of an internal pressure of the development cartridge 2 may act as a resistance to a force pressing the plunger 93, such that the refilling of the toner may not be smoothly performed.

To address such toner leakage and performance of the refilling of the toner, a structure for releasing the internal pressure of the development cartridge 2 when the refilling of the toner is performed may be provided. The release or reduction of the internal pressure may be realized by providing an air vent at the development cartridge 2, the air vent being connected to the outside. In an example, the air vent may be installed with a filter to prevent or reduce the leakage of the toner. In a case where the internal pressure is released or reduced by using only the air vent having the filter, sizes of the air vent and the filter may become very large, but it may be difficult to arrange the air vent having a sufficient size in the development cartridge 2. In a case where an air vent and a filter which have sufficient sizes are not provided, excessive air pressure may be applied to the filter and thus the filter may be damaged. In consideration of these problems, an additional structure for releasing internal pressure together with the air vent and the filter may be provided. An example of a structure for releasing the internal pressure by temporarily expanding the volume of the toner container 230 is provided.

FIG. 5 is a partially-exploded perspective view of a development cartridge to which an internal pressure releasing structure is applied, according to an example.

FIG. 6 is a cross-sectional view of the development cartridge taken along a line X2-X2' of FIG. 5, according to an example.

Referring to FIGS. 4 and 5, the toner container 230 may include a first air vent 411 and a second air vent 412. The toner refilling portion 240 may be connected to an end of the toner container 230 in a longitudinal direction and provide the toner container 230 with a path for refilling the toner into the toner container 230. The first air vent 411 may be installed with a filter 420 that prevents or reduces leakage of the toner. A pressure releasing member may communicate with the toner container 230 via the second air vent 412. The pressure releasing member may be transformable in a contracted state and an expanded state expanding a volume of the toner container 230. The first air vent 411 may be formed at a position farther from the toner refilling portion 240 than the second air vent 412.

The first air vent 411 and the second air vent 412 may be provided in, for example, the upper frame 330 forming the toner container 230. For example, the first air vent 411 may be formed through the hopper portion 230-1 and the connective path portion 230-2. An upper wall 331 of the hopper portion 230-1 may extend upward to the connective path portion 230-2 and the first air vent 411 may be provided on the upper wall 331 of the hopper portion 230-1. The second air vent 412 may be formed in the connective path portion 230-2. In FIG. 5, a plurality of second air vents 412 are provided on an upper wall 332 of the connective path portion 230-2. The second air vent 412 is positioned leaning more towards the first air vent 411 than the toner refilling portion 240.

In an example, the pressure releasing member may include a flexible bag 430 having an opening 431 connected to the second air vent 412. The opening 431 of the flexible pocket 430 may surround the second air vent 412. The flexible bag 430 may be combined to the upper wall 332 of the connective path portion 230-2, by an adhering method, a fusing method, or the like, such that the opening 431 may surround the second air vent 412. The flexible bag 430 may be connected to the toner container 230 via the second air vent 412. When the internal pressure of the toner container 230 is increased, the flexible bag 430 is transformed into the expanded state, expanding the volume of the toner container 230 as shown by a dotted line in FIG. 4, thereby releasing or reducing the internal pressure of the toner container 230. When the internal pressure of the toner container 230 is decreased, the flexible bag 430 returns to the contracted state by its own weight or a pressing member to be described below, as shown by a solid line in FIG. 4. For example, the development cartridge 2 may include an accommodating chamber 440 that accommodates the flexible bag 430. The accommodating chamber 440 may be positioned, for example, above the upper portion of the connective path portion 230-2. A chamber cover 441 covers the accommodating chamber 440. The chamber cover 441 may be provided with a third air vent 413 connecting the accommodating chamber 440 to the outside, such that atmospheric pressure may be applied to the accommodating chamber 440.

Referring to FIGS. 5 and 6, the filter 420 filters toner from air discharged via the first air vent 411 so as to prevent or reduce the toner from leaking to the outside. The filter 420 may include an inner filter 421 positioned on an upstream side with respect to an air discharge direction 424, and an outer filter 422 positioned on a downstream side. The inner filter 421 and the outer filter 422 are apart from each other in the air discharge direction 424, and a space 423 is arranged therebetween. For example, the upper wall 331 of the hopper portion 230-1 may be provided with a stepped portion 331-1 having a downward direction, and the first air vent 411 may be provided with the stepped portion 331-1. The inner filter 421 may be attached to a bottom surface of the stepped portion 331-1, and the outer filter 422 may be attached to a top surface of the stepped portion 331-1. By doing so, the space 423 corresponding to a thickness of the stepped portion 331-1 may be established.

When the toner is refilled into the toner container 230 by using the syringe-type toner cartridge 9, toner and air in the toner cartridge 9 are introduced into the toner container 230. At this time, an internal pressure of the development cartridge 2 may be increased. The filter 420 may filter the toner and discharge, to the outside, an amount of air determined by an air permeability. Since the air is discharged to the outside via the first air vent 411, the internal pressure of the development cartridge 2 is released or reduced. The air that is discharged from an inside of the toner container 230 to the outside via the first air vent 411 passes through the inner filter 421 and the outer filter 422. Toner included in the air is filtered by the inner filter 421 and the outer filter 422. Therefore, only the air is discharged to the outside, or air with a reduced amount of toner is discharged to the outside.

In a case where an amount of air introduced into the development cartridge 2 is significantly greater than an amount of air discharged via the first air vent 411 and the filter 420, the internal pressure of the development cartridge 2 may be sharply increased, and thus the filter 420 may be damaged, the toner leakage to the outside of the development cartridge 2 via the aforementioned gaps may occur, or the like. According to an example, the flexible bag 430 may be changed to the expanded state due to the internal pressure when the toner is refilled, and the volume of the toner container 230 may be expanded. By doing so, a sharp increase in the internal pressure of the development cartridge 2 may be prevented or reduced, such that it is possible to prevent or reduce excessive air pressure from being applied to the inner filter 421 and the outer filter 422. Therefore, a possibility of damaging the inner filter 421 and the outer filter 422 may be reduced. In addition, since the internal pressure of the development cartridge 2 is released or reduced to some extent by the flexible bag 430, the pressing force of the plunger 93 for refilling the toner is reduced and the toner refilling operation becomes easier. Since the first air vent 411 is positioned farther away from the toner refilling portion 240 than the second air vent 412, the internal pressure of the development cartridge 2 is released or reduced to some extent when the flexible bag 430 is changed to the expanded state by the internal pressure at the time of refilling toner, and the excessive air pressure may be effectively prevented or reduced from being applied to the inner filter 421 and the outer filter 422.

The second air vent 412 is positioned leaning more towards the first air vent 411 than the toner refilling portion 240. In other words, the second air vent 412 is positioned closer to the first air vent 411 than the toner refilling portion 240. Accordingly, the internal pressure may be released or reduced to some extent at a position close to the first air vent 411. Therefore, the excess air pressure may be effectively prevented or reduced from being applied to the inner filter 421 and the outer filter 422. In addition, the toner is more easily injected towards the toner container 230 from the toner refilling portion 240, by lowering the internal pressure at a place far from the toner refilling portion 240.

Residual pressure, that is, a pressure exceeding a capacity of the flexible bag 430, is gradually released or reduced as the air is discharged via the first air vent 411 and the filter 420. The flexible bag 430 returns to the contracted state by its own weight or by atmospheric pressure.

The outer filter 422 filters the toner together with the inner filter 421 to prevent or reduce toner from being leaked to the outside. The outer filter 422 functions as a protective member protecting the inner filter 421 from damage due to external impact or force. The space 423 is provided between the inner filter 421 and the outer filter 422 so as to prevent or reduce an external force applied to the outer filter 422 from reaching the inner filter 421. In addition, since the outer filter 422 is positioned at the stepped portion 331-1 immersed from the upper wall 331 of the hopper portion 230-1, for example, a possibility of the external force applied to the outer filter 422 may be reduced in a process of handling the development cartridge 2. In addition, the outer filter 422 may function as a safety filter to prevent or reduce the leakage of toner when the inner filter 421 partially or totally loses a function as a filter due to use for a long time.

Cell sizes of the outer filter 422 and the inner filter 421 may be determined such that it is difficult for toner to pass therethrough. In addition, the cell size of the outer filter 422 may be determined such that air passing through the inner filter 421 may pass smoothly. For example, when an average particle diameter of the toner is 5 through 8 μcm, the cell size of the inner filter 421 may be 3 μm or less. The cell size of the outer filter 422 may be 5 μm or less.

An air permeability of the outer filter 422 may be greater than an air permeability of the inner filter 421. When the air permeability of the outer filter 422 is smaller than the air permeability of the inner filter 421, air which has passed through the inner filter 421 stagnates between the outer filter 422 and the inner filter 421, and the internal pressure of the development cartridge 2 may not be stably released or reduced. When the air permeability of the outer filter 422 is greater than the air permeability of the inner filter 421, air which has passed through the inner filter 421 smoothly passes through the outer filter 422 and is discharged to outside, the internal pressure of the development cartridge 2 may be stably released or reduced. For example, the air permeability of the inner filter 421 may be about 1 sec/100 cc, and the air permeability of the outer filter 422 may be about 0.1 sec/100 cc. A thickness of the outer filter 422 may be larger than that of the inner filter 421 for functions of being a protective member or a safety member. For example, the thickness of the outer filter 422 may be 1 mm or more. For example, the thickness of the inner filter 421 may be 0.05 mm and the thickness of the outer filter 422 may be 2 mm.

In the above-described example, the pressure releasing member, according to a released or reduced internal pressure, may naturally recover to the contracted state by its own weight. However, a pressing member may be employed for applying pressure to the pressure releasing member in a direction of changing the pressure releasing member to the contracted state.

FIG. 7 is a partial cross-sectional view of a development cartridge to which an internal pressure releasing structure is applied, according to an example.

Referring to FIG. 7, the flexible bag 430 is employed as the pressure releasing member. The pressing member may be, for example, a weight member 450 attached to the flexible bag 430 and applying pressure, by its own weight, to the flexible bag 430 in a direction of changing the flexible bag 430 to the contracted state.

FIG. 8 is a partial cross-sectional view of a development cartridge to which an internal pressure releasing structure is applied, according to an example.

Referring to FIG. 8, the flexible bag 430 may be employed as the pressure releasing member. The pressing member may be an elastic member 460 which applies an elastic force to the flexible bag 430 in a direction of changing the flexible bag 430 to the contracted state. In an example, the elastic member 460 may be implemented as a compressive coil spring having one end supported by the chamber cover 441, and another end is supported by the flexible bag 430. A supporting plate 461 may be combined to the flexible bag 430 so as to support another end of the compressive coil spring. Although not illustrated in drawings, the pressing member may be implemented by a plate spring supported by the chamber cover 441 and the flexible bag 430, or the supporting plate 461 combined to thereto.

The pressure releasing member may be implemented in various forms.

FIG. 9 is a partial cross-sectional view of a development cartridge to which an internal pressure releasing structure is applied, according to an example.

Referring to FIG. 9, a bellows 470 may be employed as the pressure releasing member. An opening 471 of the bellows 470 may communicate with the second air vent 412. For example, the bellows 470 may be combined to the upper wall 332 of the connective path portion 230-2, by a method such as adhesion, fusion, or the like, such that the opening 471 may surround the second air vent 412. The bellows 470 may be accommodated in the accommodating chamber 440.

The pressing member may apply pressure to the bellows 470 to change the bellows 470 to a contracted state. The pressing member may be implemented by the weight member 450 positioned on an opposite side of the opening 471 of the bellows 470, as shown in FIG. 9. Although not illustrated in drawings, the pressing member may be implemented by the elastic member 460 in FIG. 8 which elastically presses the opposite side of the opening 471 of the bellows 470.

FIG. 10 is a partial cross-sectional view of a development cartridge to which an internal pressure releasing structure is applied, according to an example.

Referring to FIG. 10, an elastic film 480 may be employed as the pressure releasing member. The elastic film 480 surrounds the second air vent 412. For example, the elastic film 480 may be combined to the upper wall 332 of the connective path portion 230-2, by a method such as adhesion, fusion, or the like, so as to surround the second air vent 412. When the internal pressure of the toner container 230 is raised by the toner cartridge 9, the elastic film 480 expands, as shown by a dotted line in FIG. 10, and becomes an expanded state increasing the volume of the toner container 230. When the internal pressure is released or reduced, the elastic film 480 becomes a contracted state as shown by a solid line in FIG. 10. According to the structure, since the pressure releasing member has an elastic force to recover to the contracted state, a separate pressing member does not require to be employed.

Examples of the present disclosure have been described with reference to the attached drawings. However, it should be understood by one of ordinary skill in the art that various amendments or modifications may be made to the one or more examples without departing from the spirit and scope. Therefore, the spirit and scope should be defined by the following claims.

The invention claimed is:

1. A development cartridge comprising:

a toner container, including a first air vent and a second air vent, to accommodate a toner;

a developing portion to receive the toner from the toner container and having a developing roller installed therein;

a toner refilling portion, connected to an end of the toner container in a longitudinal direction, to provide the toner container with a passage for refilling the toner;

a filter installed in the first air vent to reduce leakage of the toner; and a pressure releasing member to communicate with the toner container via the second air vent and being transformable into a contracted state and an expanded state to expand a volume of the toner container, wherein the first air vent is formed at a position farther from the toner refilling portion than the second air vent.

2. The development cartridge of claim 1, further comprising a pressing member to apply a pressure to the pressure releasing member to switch the pressure releasing member to the contracted state.

3. The development cartridge of claim 2, wherein the pressing member comprises a weight member to apply the pressure by its own weight to the pressure releasing member, in a direction in which the pressure releasing member is switched to the contracted state.

4. The development cartridge of claim 2, wherein the pressing member further comprises an elastic member to apply an elastic force to the pressure releasing member, in a direction in which the pressure releasing member is switched to the contracted state.

5. The development cartridge of claim 1, wherein the pressure releasing member comprises a flexible bag having an opening connected to the second air vent.

6. The development cartridge of claim 1, wherein the pressure releasing member comprises an elastic film surrounding the second air vent.

7. The development cartridge of claim 1, wherein the pressure releasing member comprises a bellows having an opening to communicate with the second air vent.

8. The development cartridge of claim 1, wherein the second air vent is positioned leaning more towards the first air vent than the toner refilling portion.

9. The development cartridge of claim 1, wherein the filter comprises an inner filter positioned on an upstream side and an outer filter positioned on a downstream side, based on a direction in which air is discharged via the first air vent, wherein a space is provided between the inner filter and the outer filter.

10. The development cartridge of claim 9, wherein an air permeability of the outer filter is greater than an air permeability of the inner filter.

11. The development cartridge of claim 9, wherein a thickness of the outer filter is larger than a thickness of the inner filter.

12. A development cartridge comprising:

a toner container, including a first air vent and a second air vent, to accommodate a toner;

a developing portion to receive the toner from the toner container and having a developing roller installed therein;

a toner refilling portion, connected to an end of the toner container in a longitudinal direction, to provide the toner container with a passage for refilling the toner;

an inner filter installed in the first air vent to reduce leakage of the toner;

an outer filter installed outside the inner filter to protect the inner filter; and a pressure releasing member to communicate with the toner container via the second air vent and being transformable into a contracted state and an expanded state to expand a volume of the toner container.

13. The development cartridge of claim 12, further comprising a space between the inner filter and the outer filter.

14. The development cartridge of claim 13, wherein an air permeability of the outer filter is greater than an air permeability of the inner filter, and a thickness of the outer filter is larger than a thickness of the inner filter.

15. A printer comprising:

a development cartridge;

a main body in/from which the development cartridge is mounted/demounted; and a communicating portion provided in the main body to provide a toner cartridge access to a toner refilling portion from an exterior portion of the main body, wherein the development cartridge comprises:

a toner container, including a first air vent and a second air vent, to accommodate a toner;

a developing portion to receive the toner from the toner container and having a developing roller installed therein;

the toner refilling portion, connected to an end of the toner container in a longitudinal direction, to provide the toner container with a passage for refilling the toner;

an inner filter installed in the first air vent to reduce leakage of the toner;

an outer filter installed outside the inner filter to protect the inner filter; and a pressure releasing member to communicate with the toner container via the second air vent and being transformable into a contracted state and an expanded state to expand a volume of the toner container.

* * * * *